US006042035A

United States Patent [19]

Grobler et al.

[11] Patent Number: 6,042,035

[45] **Date of Patent: *Mar. 28, 2000**

[54] CRUSHING MACHINE WITH ROTOR

[75] Inventors: Hendrik W. Grobler, Neuss; Erich Köhl, Meerbusch; Wolf-Dieter Schelzig, Neuss; Eberhard Stodt, Düsseldorf, all of Germany

[73] Assignee: Svedala Lindemann GmbH, Düsseldorf, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/718,313

[22] PCT Filed: Dec. 13, 1994

[86] PCT No.: PCT/EP94/04126

§ 371 Date: Sep. 25, 1996

§ 102(e) Date: Sep. 25, 1996

[87] PCT Pub. No.: WO95/17255

PCT Pub. Date: Jun. 29, 1995

[30] Foreign Application Priority Data

Dec. 22, 1993 [DE] Germany ..... 43 43 801

[51] Int. Cl.[7] ..... B02C 13/26

[52] U.S. Cl. ..... 241/191; 241/194

[58] Field of Search ..... 241/197, 300, 241/191, 194

[56] References Cited

U.S. PATENT DOCUMENTS

| | | | |
|---|---|---|---|
| 1,785,435 | 12/1930 | Bullock | 241/197 |
| 2,712,417 | 7/1955 | Jensen | 241/197 |
| 3,612,420 | 10/1971 | Hull | 241/197 |
| 3,659,793 | 5/1972 | Stephenson et al. | 241/197 |
| 4,613,088 | 9/1986 | Hausler et al. | 241/197 |
| 5,188,303 | 2/1993 | Hoof | 241/197 |

FOREIGN PATENT DOCUMENTS

| | | |
|---|---|---|
| 2403827 | 4/1979 | France . |
| 2634401 | 1/1990 | France . |
| 2660213 | 10/1991 | France . |
| 2692172 | 12/1993 | France . |
| 1249645 | 9/1967 | Germany . |
| 2605751 | 9/1976 | Germany . |
| 3524725 | 1/1987 | Germany . |
| 3123857 | 9/1990 | Germany . |
| 9206489 | 9/1993 | Germany . |

*Primary Examiner*—Mark Rosenbaum
*Attorney, Agent, or Firm*—Darby & Darby

[57] ABSTRACT

The set-up times can be optimized as well as the costs for the production of the individual parts can be decreased with a comminution machine, where the rotor (2) includes active and inactive wear parts (7, 8), of which at least the inactive wear parts (8) are assembled in a composite construction.

23 Claims, 17 Drawing Sheets

CRUSHING MACHINE WITH ROTOR

TECHNICAL FIELD

Figure 1:
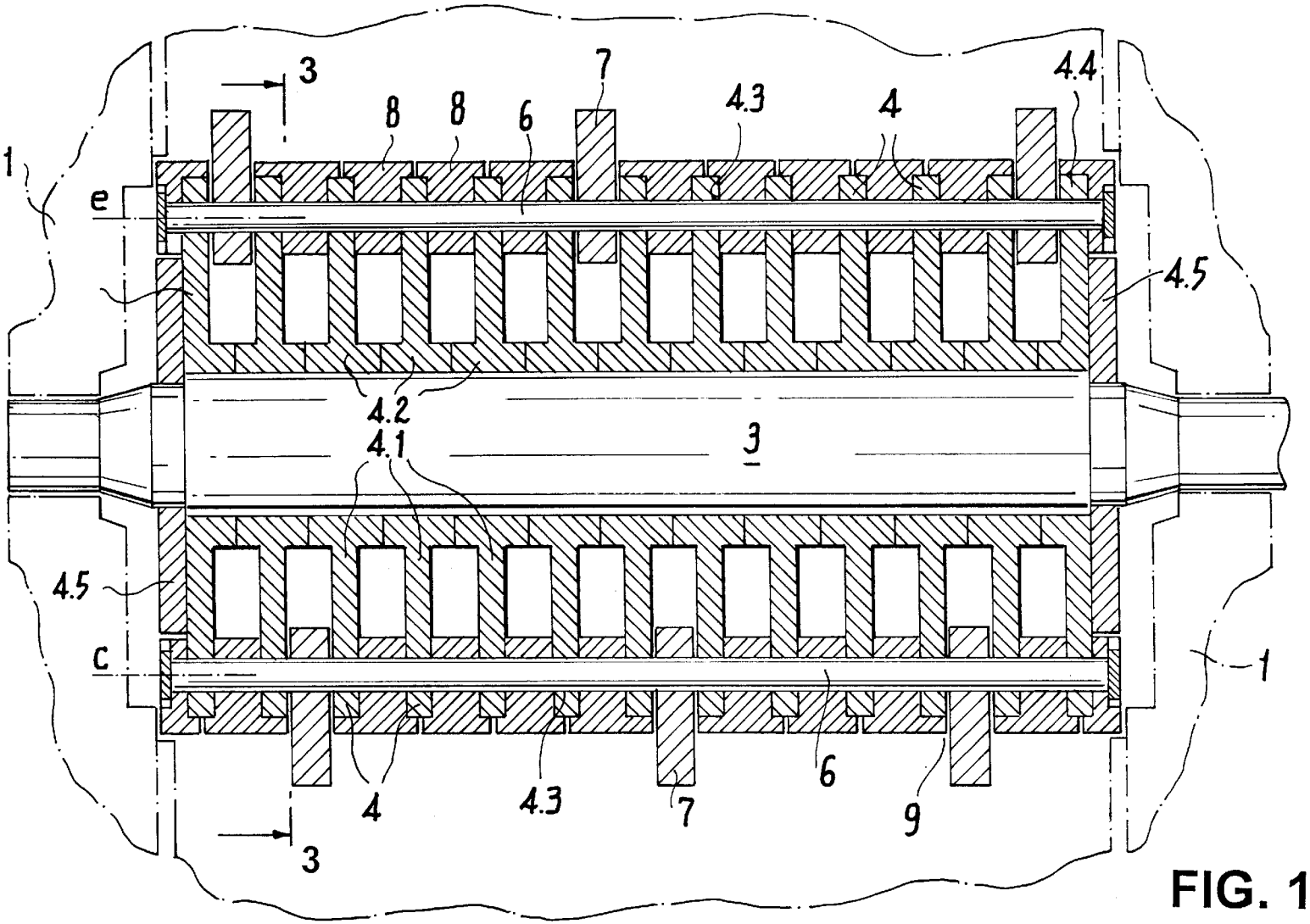

The invention relates to a crushing machine with rotor.

STATE OF THE ART

Such crushing machines or comminution machines are known in various constructions and for various materials. For example, types of construction exist, wherein the support bodies for the comminution tools are comprising a spider rotor or also a single-part rotor body. A particularly advantageous construction is the swing hammer crusher according to the German printed patent document 2,605,751, wherein the rotor of the swing hammer crusher comprises several disks, plugged onto a shaft and fixed against rotation, and of hammers disposed distributed between these disks, wherein the hammers are supported movable in rotation.

The recited comminution machines serve for the comminution of metallic and non-metallic material or of a mixture between these two types of materials and in nearly each case comprise a fixedly disposed housing, wherein the rotor is rotatably supported in said housing. In general, a so-called anvil is disposed at the inner side of the housing; and in fact preferably at the input of the housing, where the anvil cooperates in the case of the swing hammer crusher according to the recited patent with the striking tools or hammers, disposed movably at the rotor. In general, the rotor, coupled with a fast rotating drive, is for this purpose equipped with a plurality of axles, where the axles are disposed parallel to the rotor shaft and wherein, however, the axles are staggered eccentrically relative to the rotor shaft, wherein the hammers or the rotor tools are supported freely rotatable on the axles. The comminuting is performed by the coaction of the rotor hammers both with the fixedly disposed anvil at the input of the material and with the inner wall of the housing, which has the function of a counter tool, and against which housing inner wall the material is thrown or at least in a part area of the rotor circumference also is squeezed or, respectively, torn between the housing inner wall and the comminution tools.

The rotor hammers are distributed in any suitable way at the circumference of the rotor at a distance relative to each other. In order to generate this distance, the rotor body is formed of a plurality of disks, which are all connected to the rotor shaft fixed against rotation.

In particular in those cases where the material to be comminuted comprises completely or in part metal, the outer faces of the disks, between which disks the rotor hammers are swivelably supported, suffer substantial wear damages based on rubbed-off parts and impinging of the material pieces. After a relatively short operating time, so much metal is then ripped off or ground off from the circumference of the disk that the disks become unusable and have to be exchanged or have to be built up by welding in an expensive way.

The proposal according to the recited patent avoids this disadvantage by furnishing protective shields comprising of a particularly wear-resistant material or also so-called protective caps, which are essentially formed in each case out of a circular-ring segment-shaped covering part and in each case of a bearing hub, furnished at the inner side of the covering part, and which covering parts are attached with the bearing hubs on the axial rods, and wherein the protective shields or protective caps cover with their covering parts the circumferential areas of the respective neighboring disks.

While this kind of construction of swing hammer crushers has proven itself useful in practice already for already two decades in an extremely wide range, it is nevertheless to be considered that both the known protective caps as well as the comminution tools, i.e. in the case of this swing hammer rotor, the hammers are cast such that these parts are not only relatively expensive in their production, but require also the relatively greater tolerances of casting, which have to be taken into consideration during the assembly of the machine and the mounting of the recited parts.

Furthermore, the wear of hammers and protective shields or, respectively, protective caps varies, since the hammers are subjected to a greater demand of wear as active tools than the inactive protective shields or, respectively, the protective caps, such that different service lives hold for two components subjected to wear which in turn leads to different intervals for their exchange and/or refinishing with the result of correspondingly irregular and thereby time-consuming shut-down times for the comminution machine.

These difficulties hold in addition to an even larger degree for the remaining initially recited kinds of constructions, where their protective shield system or, respectively, their protective cap system, if they are furnished with one of these at all, are by far not as simple a construction as the one according to the recited patent. It is in addition common to all comminution machines of this kind that the tools and possibly the wear-protective parts are cast parts.

There are finally solutions known, amongst others, according to the German printed patent document 3,123,857 and according to the German Petit Patent document 9,206,489, which aspire to a high stability against wear, but which remain limited one-sidedly to active wear parts or tools and which are in addition expensive.

According to German printed patent document DE-A-3,524,725 a hammermill is described, wherein the protective means (protective shields/protective caps) are comprised of a multi-part high-wear-resistant sleeve, extending over the length of the rotor and furnished with openings for the hammers, wherein, in case of a disk rotor, the sleeve is composed out of two half-shells, i.e. the sleeve is axially subdivided.

Furthermore, it is known from the German printed patent document DE-B-1,249,645 that hammers for hammermills are made of materials of differing hardness, amongst others such that the hammer comprises a composite steel.

In addition, the solution with curved wear segments, which has become known from the French printed patent document FR-B-2,692,172 and analogously the German printed patent document DE-C-4,219,449, where the wear segments exhibit L shaped claw elements and which represent in a further sense composite wear segments, does not provide any suggestion for the solution of the following problems and the thereby resulting existing purposes.

DESCRIPTION OF THE INVENTION

Figure 10B:
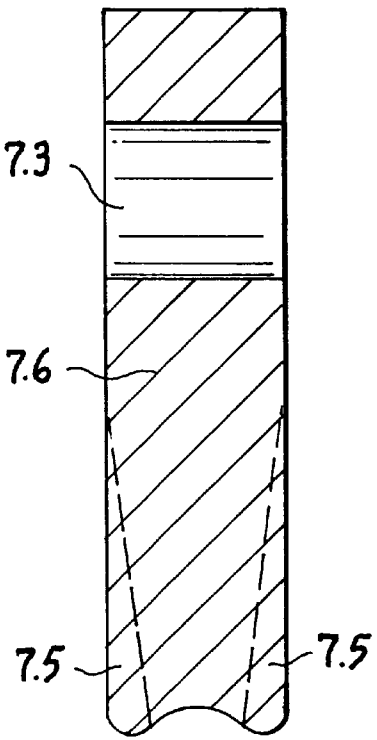
Figure 10A:
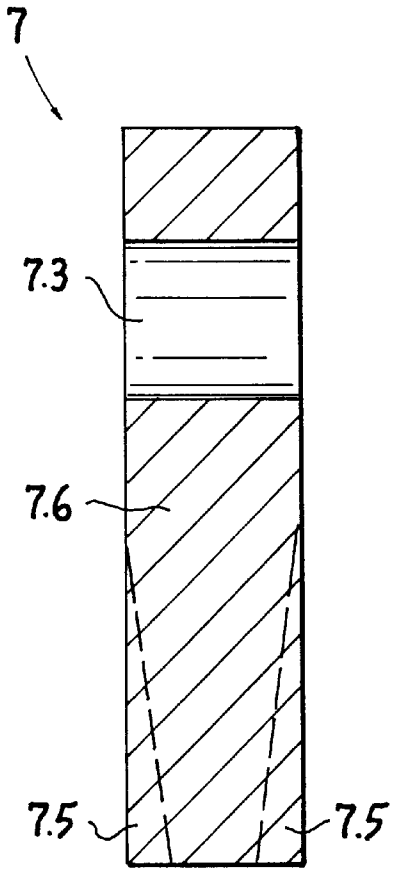

In this context, the hammer 7 shown in FIG. 10*a* has a cross-section shown in FIG. 10*b* in a new/unused state, and the hammer 7 shown in FIG. 10*a* has a cross-section shown in FIG. 10*c* in a used state.

If in this context the language relates to "active" wear parts on the one hand and to "inactive" wear parts on the other hand, then these designations take into consideration that the comminution tools, for example, the hammers, are subjected to a different wear (active wear) based on their active comminuting work, as compared to the coverings serving for the wear protection of other machine parts, such as for example the protective shields, which in fact do not actively participate in the comminution process, however, are however subject to wear based on the whirling-around feed material, as recited initially, based on rub-off and on impacting material pieces (secondary wear of the inactive components).

The teaching according to the invention does not only lead to a decrease in the costs of the production of individual parts as well as to an increase in the shut-down times, in that less differing change phases of the active and inactive wear parts are achieved, but additionally opens a multitude of construction possibilities for an optimum wear part system.

The optimum wear behavior is realizable in a multitude of ways within the framework of the invention based on wear parts which are correspondingly adapted to each other in their construction, their given shape, their material composition, and/or their mutual coordination. If at least the inactive wear parts are formed in a composite construction, there results the possibility to select shape and material for the individual parts of the composite such that the composite can be adapted in its wear behavior to the respective other components, where it is of course within the frame of the invention that the one wear part kind, for example the hammers, are constructed as ever from casting, whereas the other wear part kind, for example the protective shields or the covering caps, are made of a composite of different steel sheets.

The surprising advantage is associated with the composite-type construction, that substantially lesser tolerances are required than with respect to cast parts, such that the fitting problems can be minimized while a more compact construction is possible at the same time. The parts, forming the composite, can in addition be rationally and precisely produced from steel sheets with the technique of laser burning.

The composite construction is comprised of zones of different material properties, such as quality, hardness, toughness, and/or thickness. This can be achieved for example by a targeted thermal treatment. The cover faces or, respectively, the cover parts of the inactive wear parts (protective caps) can thus be furnished with a greater hardness, which is more resistant to wear than the webs or the hubs of the covering parts.

It is proposed in an embodiment of the invention that the active and/or inactive wear parts are detachably and/or nondetachably assembled, such that for example, on the one hand, screws or rivets and, on the other hand, welding, soldering, gluing and the like are possible or also combinations thereof for the compositing.

An advantageous addition of the invention represents the sandwich construction, wherein for example the hammer in total and of the protective caps only the cover faces are made in the sandwich construction.

If in this context the construction of the hammers looks such that two relatively hard, wear-resistant layers or plies include between themselves at least one softer layer, i.e. the hard, wear-resistant layer is applied on the two sides of the side faces of the softer core layer, then there results in an advantageous way a self-sharpening sandwich construction for the hammers, since the softer core layer then wears faster at the free front faces than the lateral harder cover layers, such that the hammer ends receive a drawn-in shape in the region of the core, whereby the relatively thereto projecting cover layers lead to a better comminution effectiveness as well as to a higher stability.

This cross-sectional shape, receding or, respectively, drawn in at the impacting or, respectively, comminution edges of the hammers in its core region, can also be furnished already in case of unused hammers based on the sandwich construction according to the invention, wherein the softer core layer is selected smaller in its dimension at these positions than the cover layers relative to the harder cover layer.

The softer, preferably tough material layers or, respectively, material regions are particularly advantageous in the region of the bearing eyes, furnished for example with harder bushings, of the hammers and of the protective caps, are however also associated with substantial advantages as core layers for the hammers and, in the case of the multi-layer composite construction, for the cover parts of the protective caps, for example as the lower layer or, respectively, the intermediate layer which substantially reduce the breaking danger of the wear parts.

The construction of the wear parts according to the present invention out of plies, zones, regions and/or layers of different material properties allows in addition to the mutual adaptation of the wear behavior and of the optimum adjustment to the composition of the material to be processes also new paths of the spatial coordination of the two wear part kinds relative to each other, in that layers or, respectively, regions can now be assembled to each other such that they can fulfill also several tasks simultaneously based on their different properties as composite component. An inactive wear part, i.e. in this case a protective cap at the lateral cheeks, can thus be structured or, respectively, constructed such that, for example, the bearings for the hammers are generated or, respectively, disposed at the lateral cheeks, whereby an axial rod attachment for the hammers can be dispensed with, which can lead in an individual case to a simplification and facilitation of the exchanging of the hammers.

In the case of the hammers, the softer intermediate layer or, respectively, the core layer does not have to be covered over its entire two lateral main faces with a harder cover layer, but rather the latter harder cover layers can exhibit breakouts reaching to the core layer, are in particular furnished only in the lateral edge region, and in fact preferably in a form adapted to the outer contour of the hammer also of the recess in the cover layer. In this way, material can be saved; the production of these contoured cover layers provided with breakouts is possible without any problems by way of laser cutting and/or contour burning. If in this case the cover layers are preferably welded onto the core layer, then the course of the hardness in the edge region also of the core layer can thereby be additionally influenced in an optimum way for the wear behavior of the hammer.

With respect to the construction of the face shapes and/or body shapes for the wear parts, in particular the hammers, it is within the scope of the invention that these are adaptable to the different wear zones and wear behavior.

A further advantage results in connection with the invention for the protective caps, in particular for their cover parts or, respectively, cover faces, since these can now comprise in each case angled-off part faces, i.e. only an angling of planar plates or, respectively, sheets is then required in order to approach more or less the rotor radius, which is more cost favorable and simpler relative to correspondingly bent cover parts, in particular however an enormous price advantage in the production costs relative to the up to now known cast protective caps. In principle, the angled-off cover face can also comprise planar part faces, which are assembled correspondingly. Based on this step, the shape of the arc of the cover face can be replaced in a simple and multiple way by a polygonal welding construction.

The advantages of the composite construction according to the present invention simplify not only the production of the wear parts, but also disclose in particular simply produceable, different shapes for the cover parts of the protective caps, whereby there result particularly good structural design possibilities for the protective jacket of the rotor, axially and radially subdivided according to the invention, which design possibilities to be adapted to the use of the comminution machine and the mutual influencing of the parts moving relative to each other. Thus, the cover parts or, respectively, the cover faces can for example be staggered or, respectively, notched in their angled-off circumferential face, i.e. they can have an L shape, such that, based on the meandered course of the contacting lines of the cover part, on the one hand, a circumferential contacting line is avoided, which could give rise in the course of time to a particular wear in this region, and on the other hand, there is thereby also provided an even greater possibility of variation of the hammer image while simultaneously reducing the contacting slots or, respectively, the separating grooves between neighboring protective caps. This variable shape of the protective caps allows also an optimum construction of the free spaces required for the swinging through of the hammers.

If protective caps are furnished which are staggered or, respectively, notched in their cover face, then it can be recommended to provide two axially aligned bearing eyes in the wider protective cap region such that the mounting supports protrude between at least three neighboring rotor disks. If the cover part covers on its circumference over two hammer axles, then it is recommended to dispose at least one further mounting support radially or, respectively, staggered relative to the circumference.

Further details of the invention which are explained in detail by way of the embodiments illustrated in the drawings result from the remaining claims as well as from the following description. There is shown in the drawings:

SHORT DESCRIPTION OF THE DRAWINGS

Figure 2:
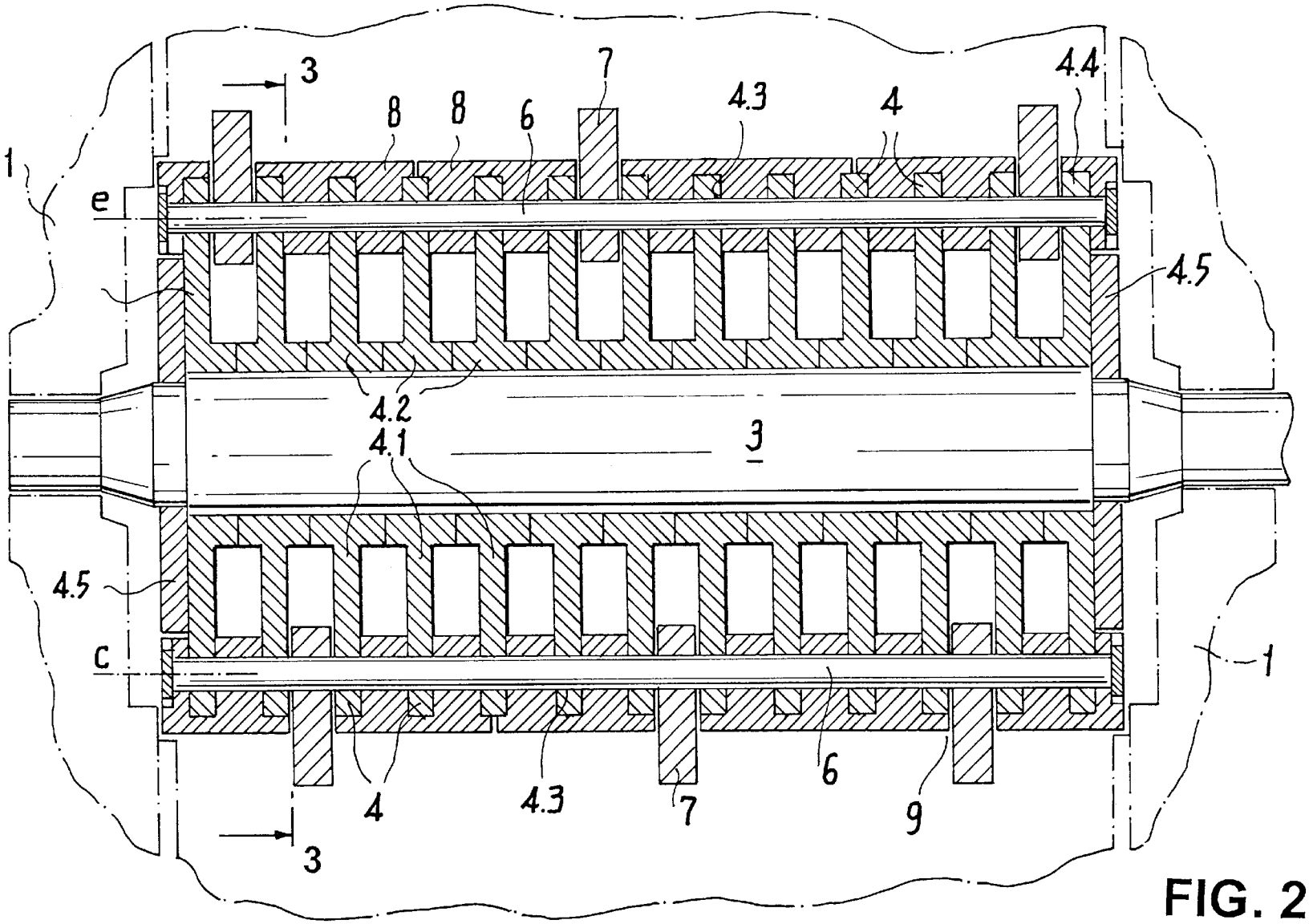
Figure 3:
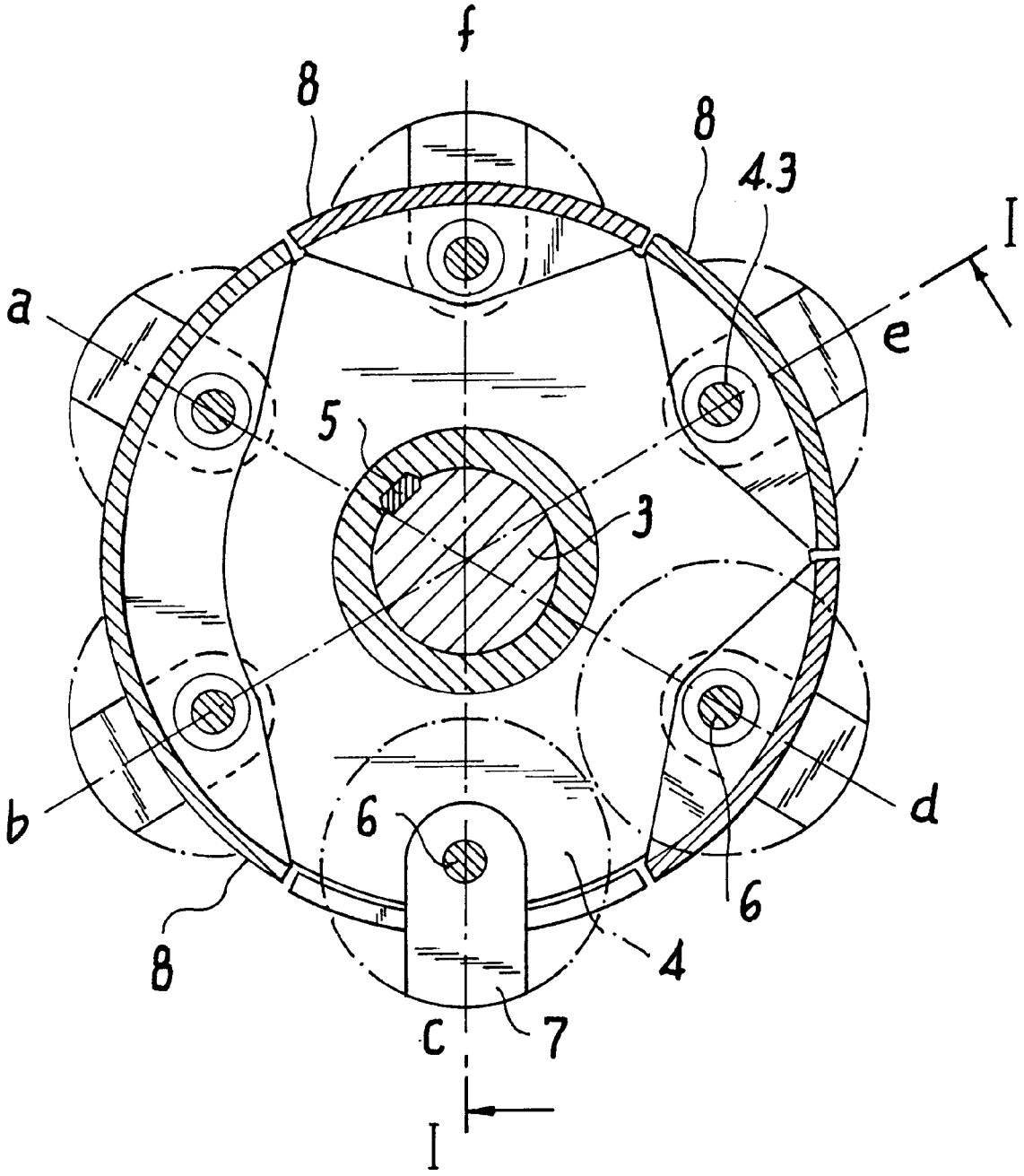
Figure 4:
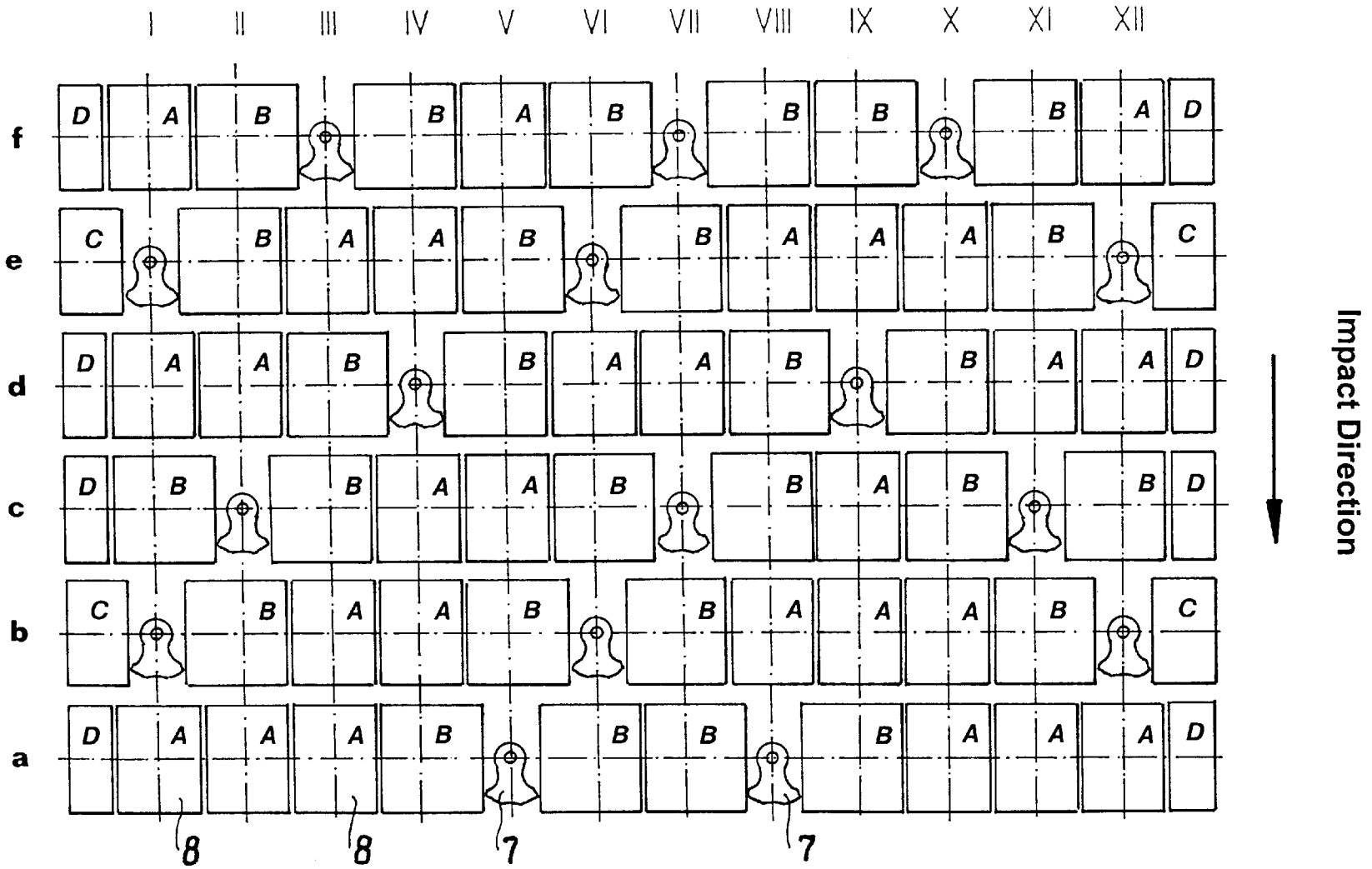
Figure 5:
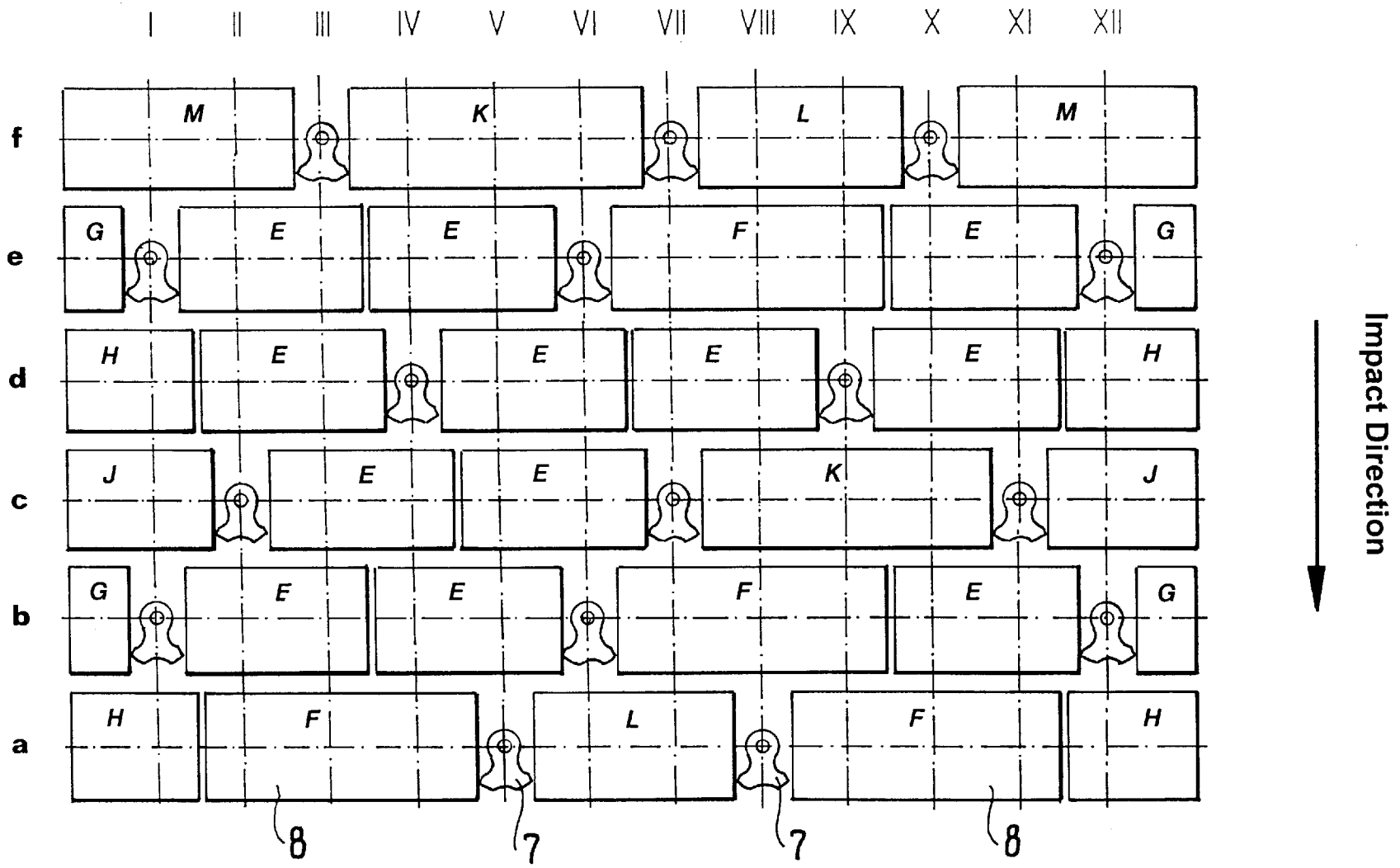
Figure 6:
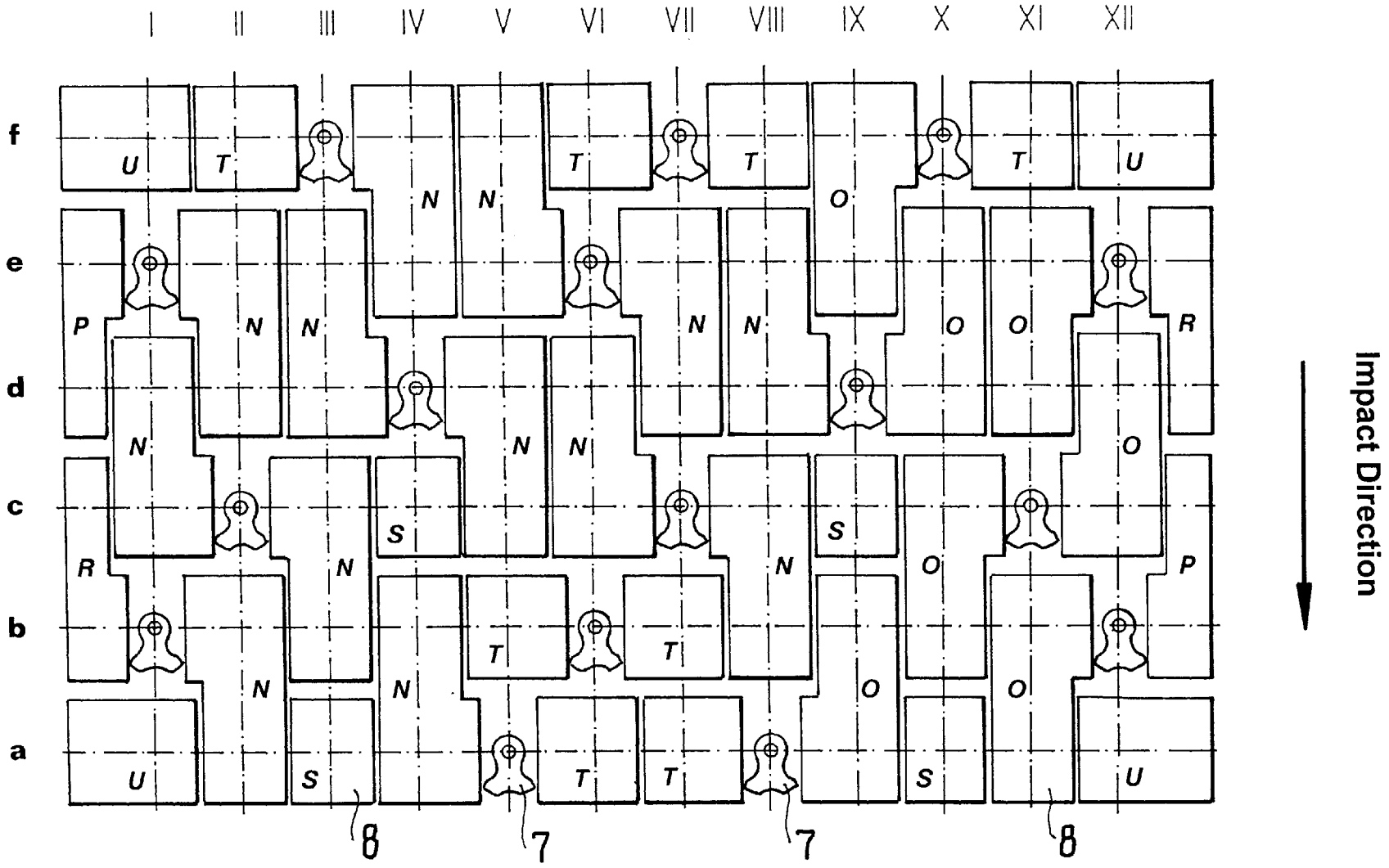
Figure 7:
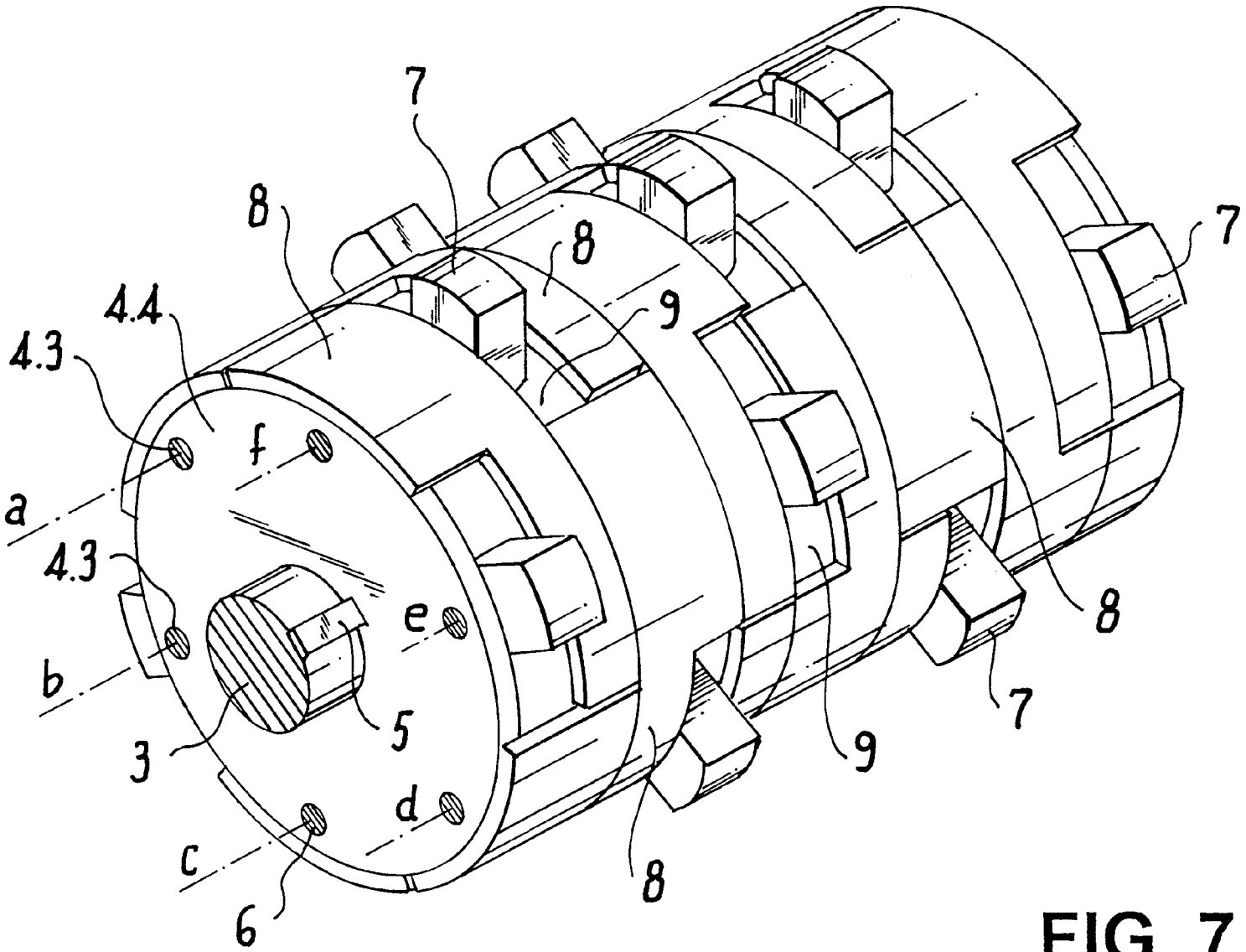
Figure 8:
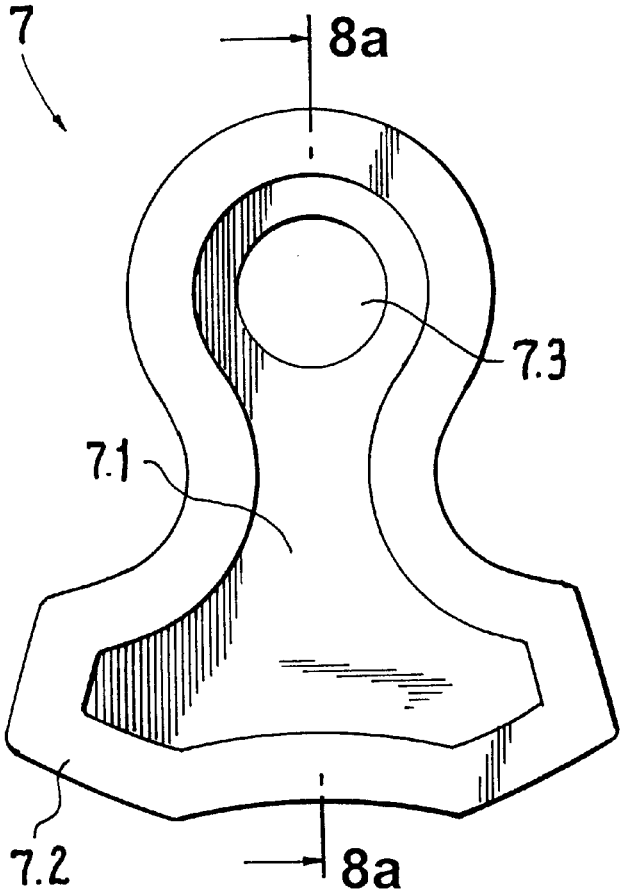
Figure 8A:
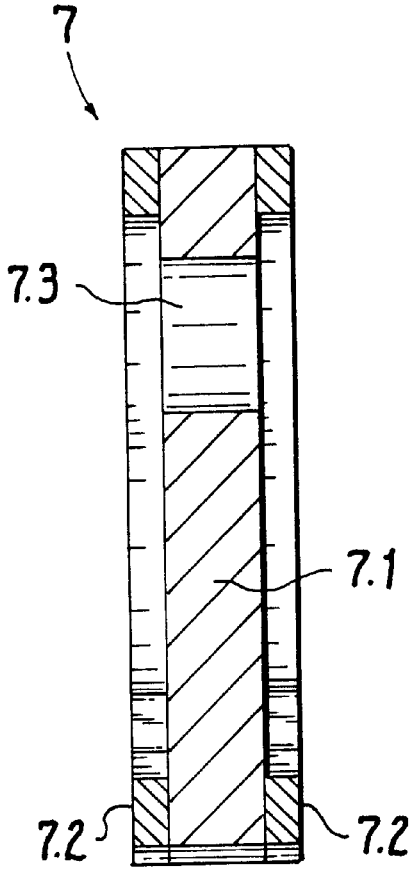
Figures 9A, 9B, 9C, 9D:
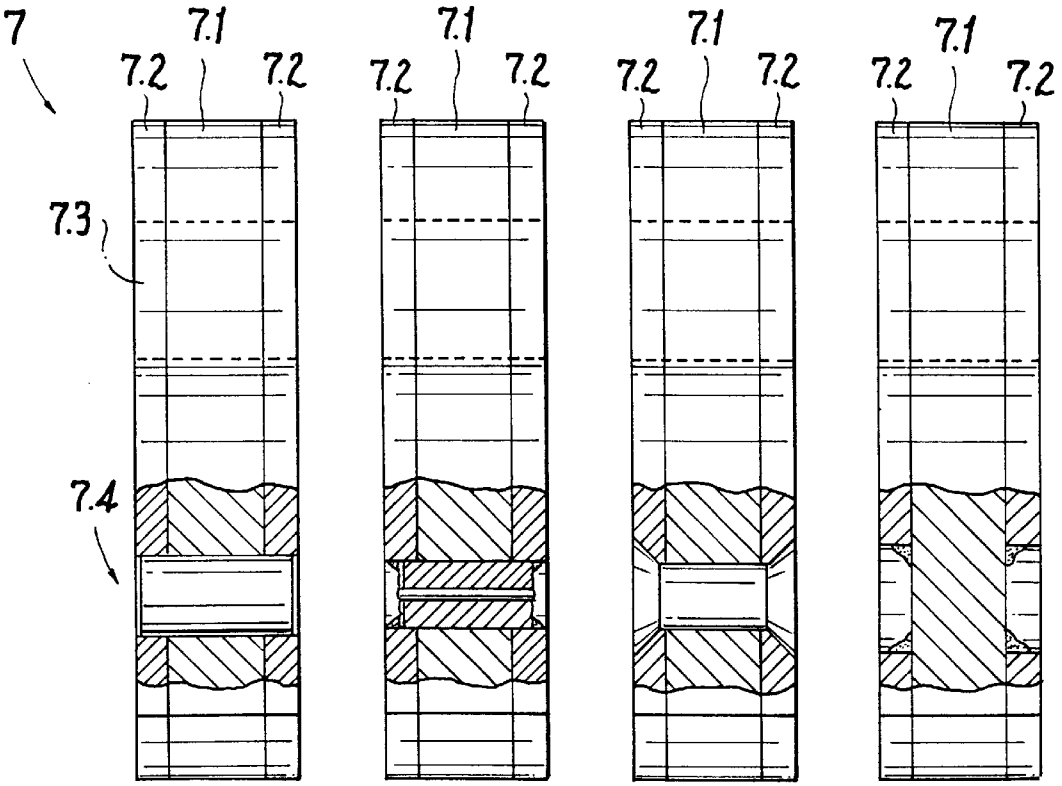
Figure 9:
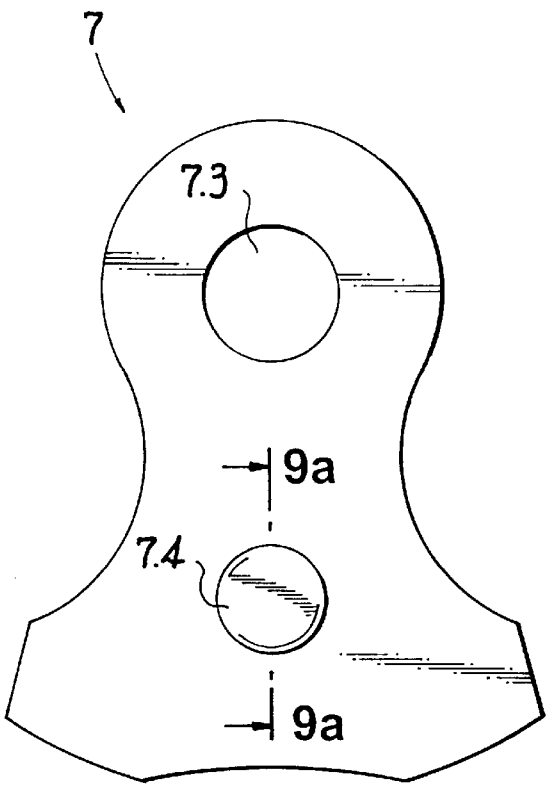
Figure 10:
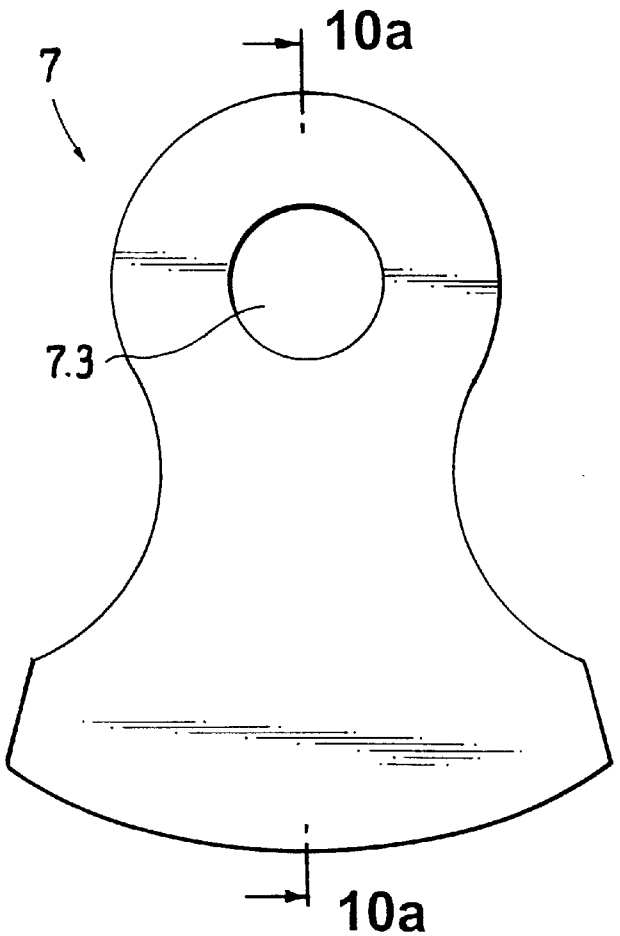
Figure 11A:
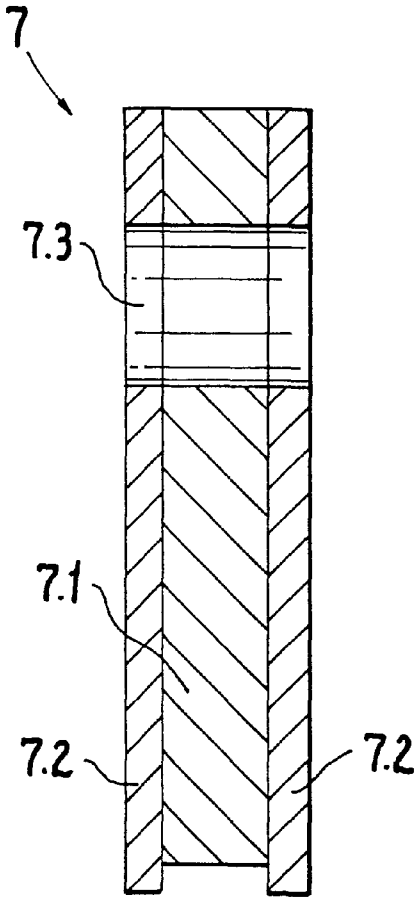
Figure 11:
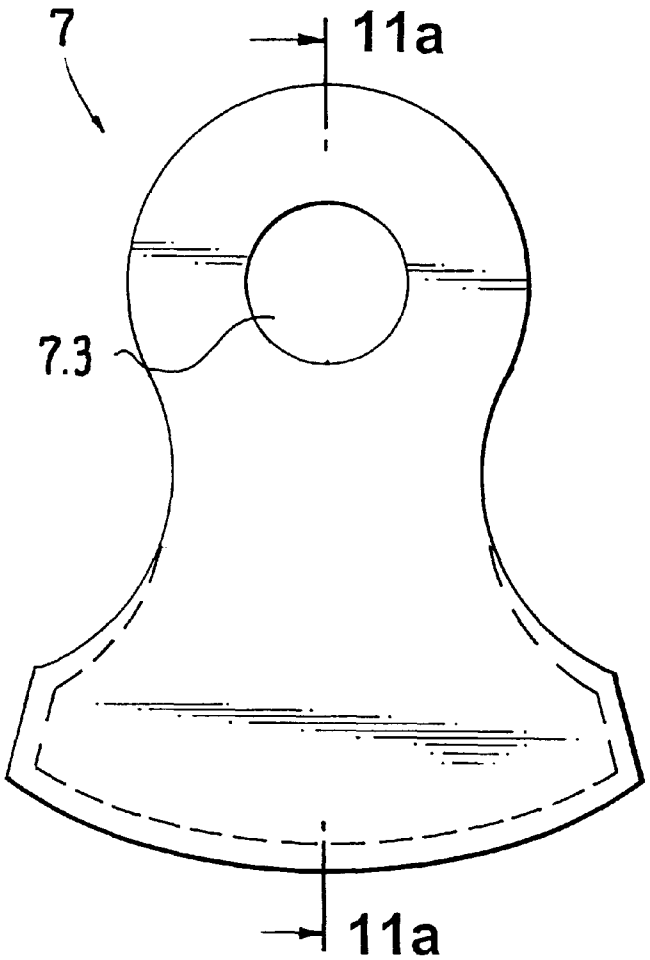
Figure 12B:
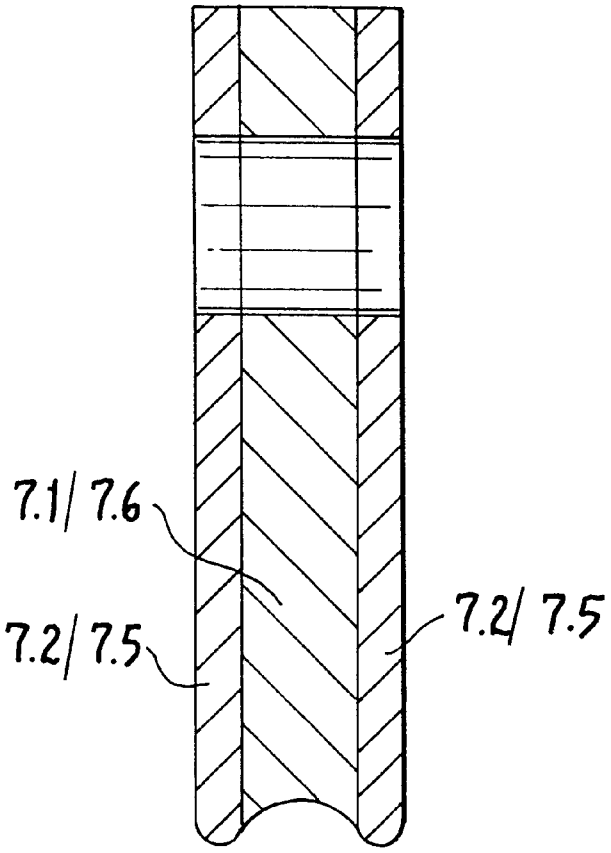
Figure 12A:
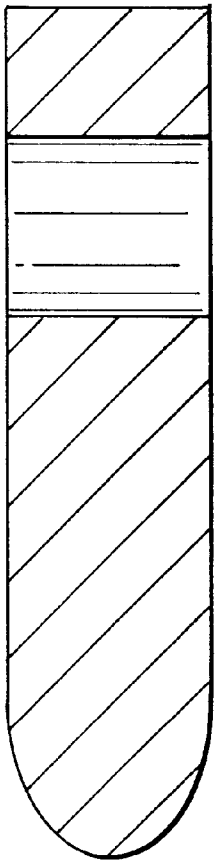
FIG. 12a (Prior Art)
Figure 13A:
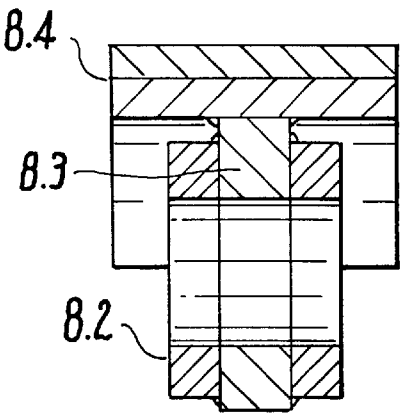
Figure 13B:
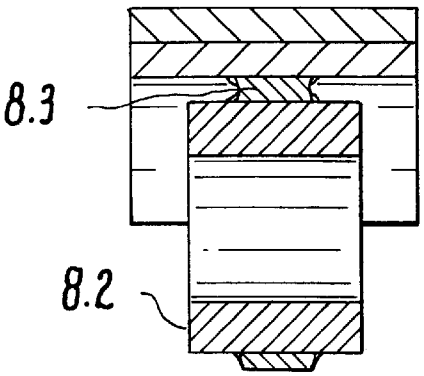
Figure 13:
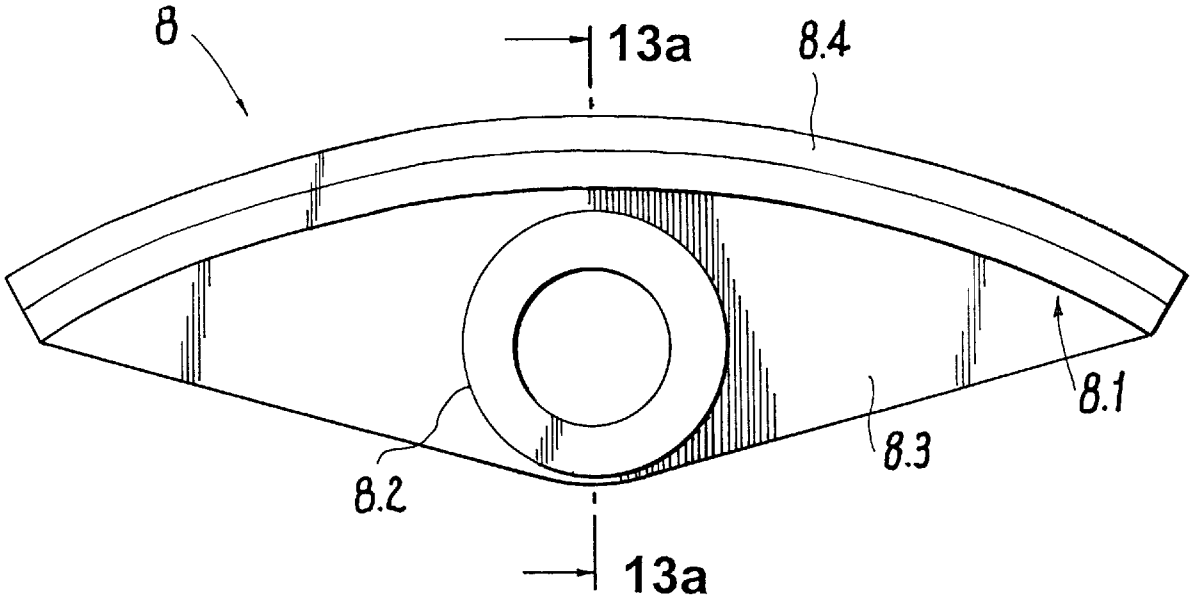
Figure 14A:
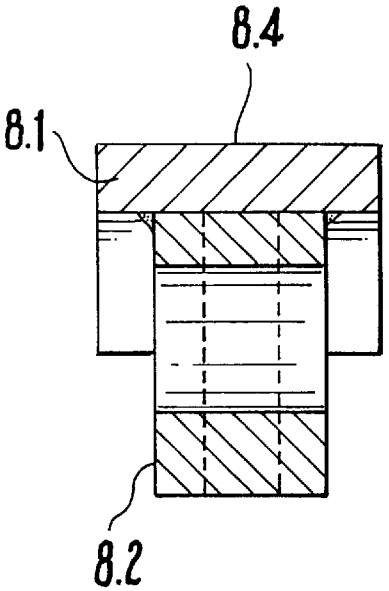
Figure 14:
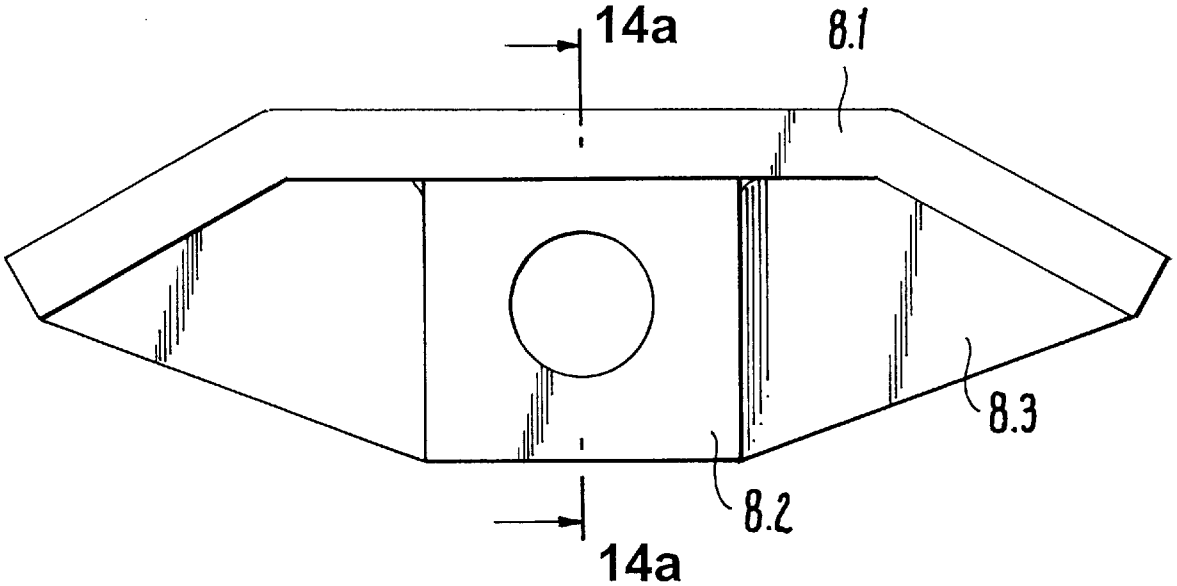
Figure 15:
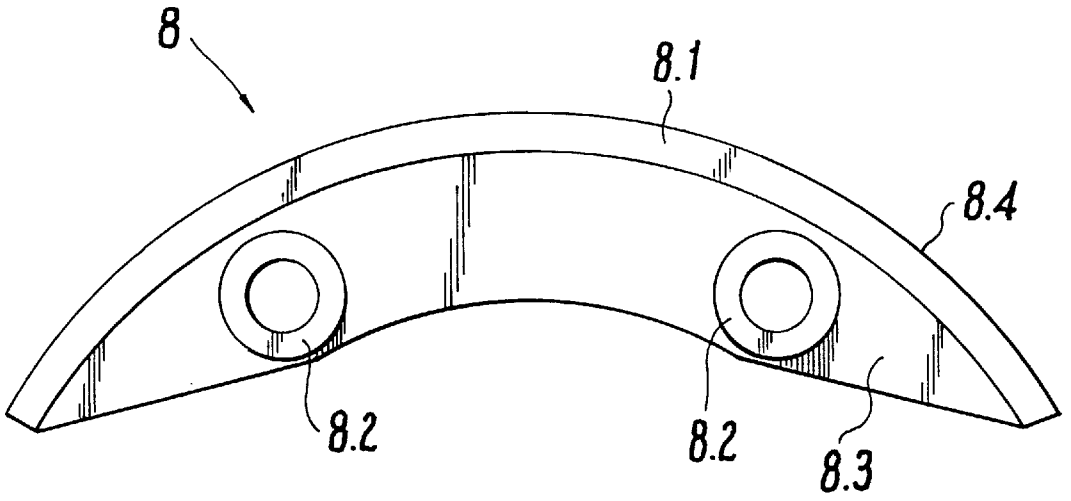
Figure 15A:
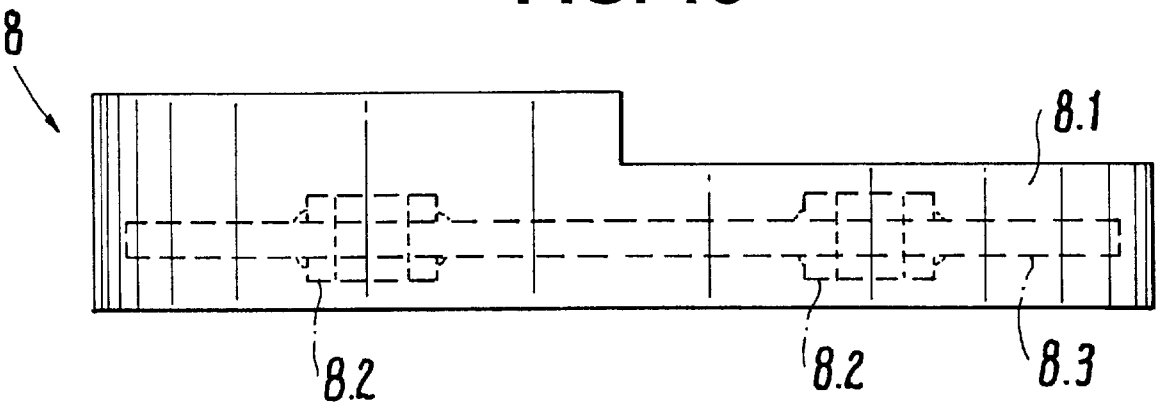
Figure 16:
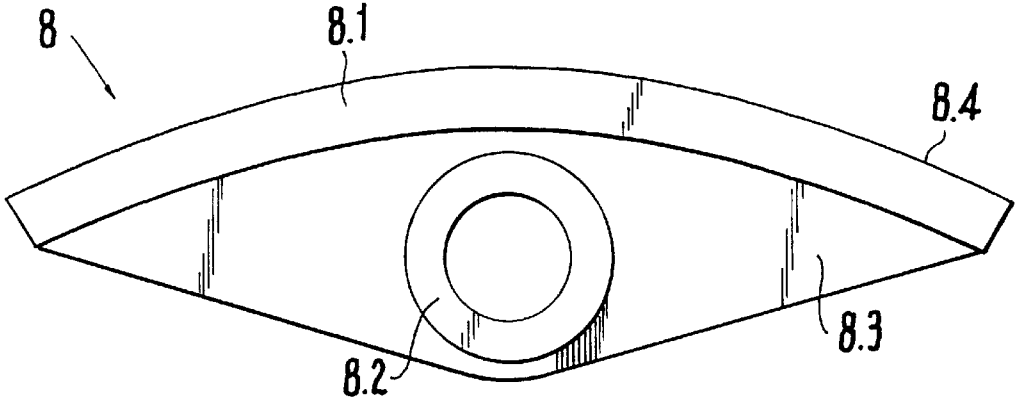
Figure 16A:
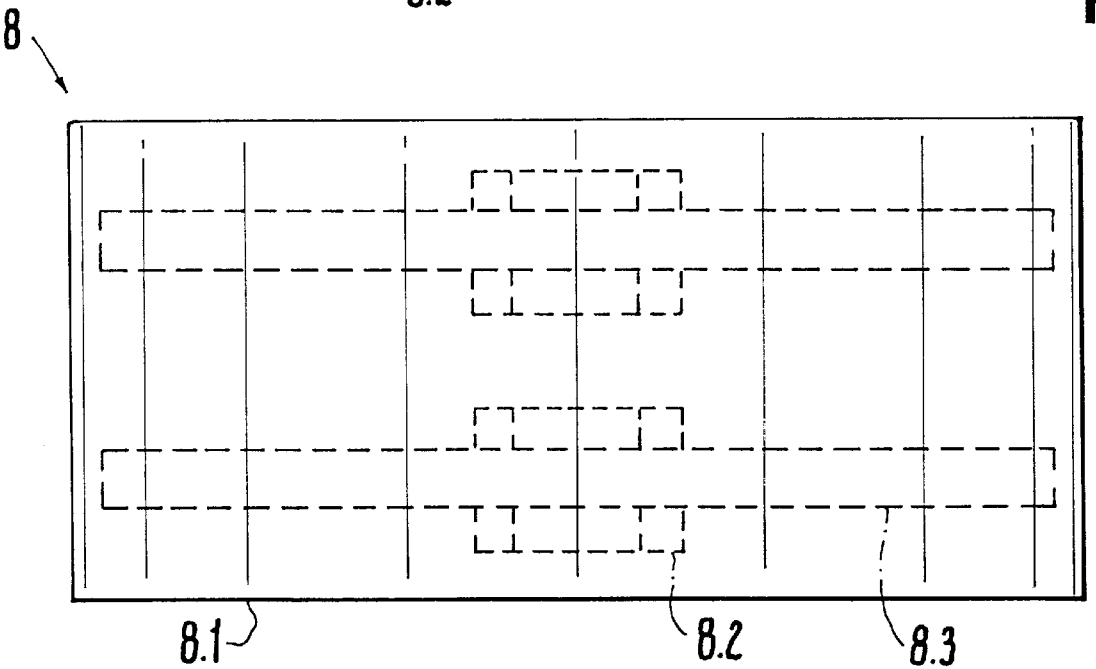
Figure 17:
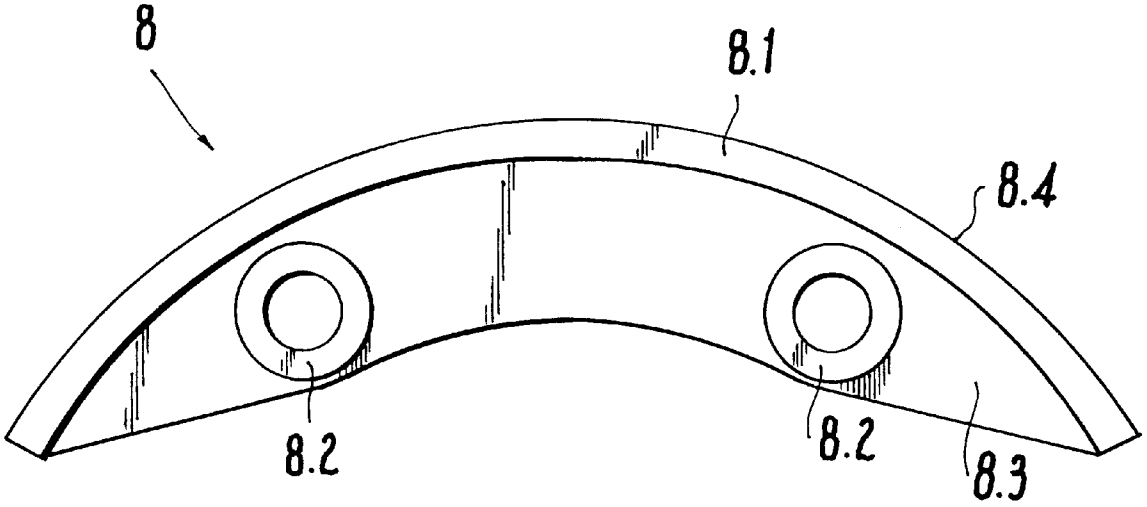
Figure 17A:
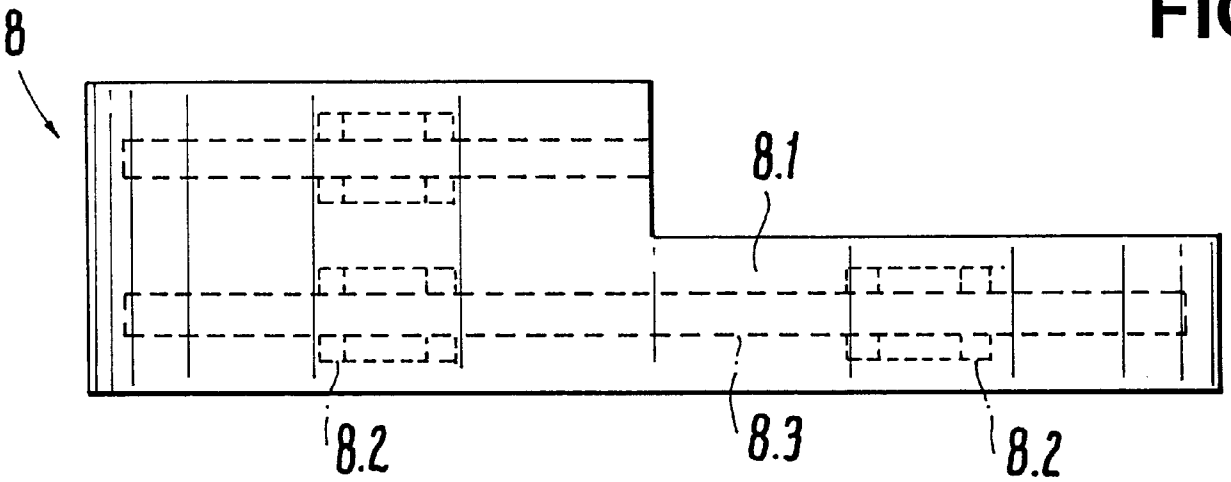

FIG. 1 a longitudinal sectional view through a rotor of a comminution machine along section line I—I in FIG. 3 at the positions "c" and "e" with arrangement of the wear parts according to FIG. 4;

FIG. 2 a longitudinal section through a rotor along section line I—I in FIG. 3 at the positions "c" and "e" with arrangement of the wear parts according to FIG. 5;

FIG. 3 a cross-section through a rotor along section line 3—3 in FIG. 1 or FIG. 2 with the attachment positions "a" through "f" for the wear parts, whereby an inactive wear part according to FIG. 15 or FIG. 17 and according to FIG. 6 is illustrated at the positions "a" and "b";

FIG. 4 a schematically illustrated layout of a rotor jacket for illustrating the disposition of the wear parts according to FIG. 1 in the positions "a" to "f" according to FIG. 3, wherein the active wear parts are shown tilted by 90 degrees in the drawing plane for a better distinction;

FIG. 5 a schematically illustrated layout of a rotor jacket for illustrating the disposition of the wear parts according to FIG. 2 in the positions "a" to "f" according to FIG. 3 and illustration of the inactive wear parts according to FIG. 16;

FIG. 6 a schematically illustrated layout of a rotor jacket analogous to FIG. 4 and FIG. 5 with inactive wear parts according to FIGS. 13 to 15 for illustrating a particular arrangement of the wear parts with respect to mutually correspondingly adapted wear behavior;

FIG. 7 a perspective, simplified illustration of a rotor of a comminution machine with a schematic arrangement of the active wear parts in a centrifugal force function and of the inactive wear parts corresponding to the cover faces according to FIG. 15 or FIG. 17;

FIGS. 8 and 8A an active wear part in a composite construction, in particular, a sandwich construction;

FIG. 9–9*d* an active wear part in a composite construction, in particular, a sandwich construction, with detachable and nondetachable types of assembly as well as layers of different hardness;

FIGS. 10–10*b* an active wear part with zones of different hardness and illustration of the wear state;

FIGS. 11 and 11A an active wear part in a composite construction and in particular a self-sharpening sandwich construction;

FIGS. 12–12*b* illustrations of the wear state of a conventional active wear part (FIG. 12*a*) and of an active wear part according to the present invention (FIG. 12*b*);

FIGS. 13 and 13*b* an inactive wear part out of a composite of cover face and mounting support with differently hard zones, layers or plies of the cover face;

FIGS. 14 and 14*a* an inactive wear part with a cover face, which comprises angled-off part faces;

FIGS. 15 and 16*a* an inactive wear part with cover face formed staggered or, respectively, notched, and with two radially or, respectively, circumferentially staggered mounting supports;

FIGS. 16 and 16*a* an inactive wear part with two axially aligned mounting supports; and FIGS. 17 and 17*a* an inactive wear part with three mounting supports, of which two are axially aligned and the third is radially or, respectively, circumferentially staggered.

PATHS FOR PERFORMING THE INVENTION

The following exemplified embodiments are illustrated by way of a comminution machine, formed as a swing hammer crusher. According to FIGS. 1 and 2, a rotor 2 with a shaft 3 is disposed rotatably in a housing 1, indicated with dash-dotted lines but not further illustrated. Several disks 4 are supported, fixed against rotation, for example, by a feather key 5 (FIG. 3, FIG. 7) on the shaft 3.

The shaft 3 can be placed in rotation by a drive, not illustrated.

The disks 4 comprise flanges 4.1 as well as hubs 4.2 and exhibit boreholes 4.3, which boreholes are disposed on the same part circle. The disks 4 are disposed with their hubs 4.2 on the shaft 3 tight-fittingly to each other, and are formed as end disks 4.4. with covers 4.5 for providing an ending at the rotor ends.

The disks 4 form together with the hubs 4.2 and the flanges 4.1 on the shaft 3 a multi-part rotor body or support body of the rotor 2 for the swing hammer crusher (FIGS. 1 and 2).

Axle rods 6 are furnished parallel to the shaft 3 and staggered radially against the shaft 3 as well as staggered circumferentially relative to each other, which axle rods 6 penetrate the boreholes 4.3 in the disks 4 corresponding to the positions "a" to "f" (FIG. 3). The axle rods serve as an attachment for active wear parts 7, so-called hammers, and for inactive wear parts 8, so-called protective caps.

The active wear parts 7 are supported eccentrically on the axle rods 6 in a rotatable way, i.e. freely rotatable, and comminute in a centrifugal force position (FIG. 3) in cooperation with one or several non-illustrated counter tools of the housing 1 a material to be processed, not determined here in greater detail.

The inactive wear parts 8 form with their cover faces 8.1 a substantially cylindrical jacket, which protects the disks 4 against wear.

Arrangements of the wear parts 7, 8 are shown for example schematically as layouts in the FIGS. 4, 5, and 6. The Roman numerals designate in the figures center lines of the spaces between the flanges 4.1 of the disks 4 and the letters "a" through "f", show the center lines of the axle rods 6. The attachments or, respectively, bearing positions of the rotatable, active wear parts 7 are in this case in the region of the section points f-III, f-VII, f-x, e-I, etc., as well as the attachment positions or, respectively the mounting supports of the inactive wear parts 8 are in the section points f-I, f-II, f-IV, etc. (FIG. 4), or, respectively, f-I/II, f-IV/V/VI, f-VIII/IX, etc. (FIG. 5), or, respectively, f-I, f-II, f/e-IV, etc. (FIG. 6). It is thereby recognizable in connection with FIGS. 1, 2, and 3 that the active wear parts 7 can swing through (centrifugal force function) in free spaces 9 (FIGS. 1, 2, and 7), which are limited by the inactive wear parts 8, in working position, i.e. with a rotating rotor. This state of the rotor 2 is illustrated in a simplified way in FIG. 7. There can be seen the free spaces 9, formed by the arrangement and structuring of the inactive wear parts 8, as well as the active wear parts 7, indicating the state of operation and protruding outwardly based on the effect of the centrifugal force.

The various arrangement of active and inactive wear parts 7, 8 according to FIGS. 4 through 6 in connection with FIG. 7 are to illustrate that the functional unit rotor 2 with the active wear parts 7 and the inactive wear parts 8 is subjected during the comminuting process in the sense of the invention to an active wear and to an inactive wear. In general, the wear of the active wear parts 7 necessarily amounts in this case to a multiple of the wear of the inactive wear parts 8. In the sense of the objects of the present invention, this different wear is to be designed such to result in predetermined, if possible coinciding time intervals.

It is shown in the further embodiments that the active and inactive wear parts 7, 8, adapted to the wear during the comminuting process according to the invention in their construction, their shape, their material composition and/or their mutual coordination, lead to a mutually coordinated, advantageous wear behavior.

A hammer as an active wear part 7 is illustrated in FIG. 8 in a composite construction, in particular a sandwich construction, in a side view and in a section. The assembly in a composite construction includes in the sense of the present invention detachable and/or nondetachable assembly means or, respectively, assembly types such as, for example, screws, bolts, tensioning pins, rivets, welding, soldering, shrinking, gluing, or the like, and in fact by itself or in combination. This hammer 7 comprises a core layer 7.1 and a cover layer 7.2 on two sides, as well as a borehole 7.3 for the rotary-movable, eccentric bearing on the axle rod 6 (FIGS. 1, 2, 3, and 7). The cover layers 7.2 are broken out in the shape of the outer contour of the hammer 7 such that the core layer 7.1 is open in the region of the borehole 7.3 and the inner edges of the cover layer 7.2. The cover layers 7.2 exhibit a greater hardness relative to the tough or softer furnished core layer 7.1. Advantageously, the bearing region of the hammer 7 is thereby constructed tough and the active wear region proper is constructed hard and resistant to wear.

A further embodiment of a hammer 7 with hard cover layers 7.2 and soft core layer 7.1. can be gathered from FIG. 9, which shows in the corresponding longitudinal sections detachable and nondetachable connections 7.4 by way of bolts, tensioning pins, rivet welding and hole welding for fixing the hard cover layers 7.2 on the softer core layer 7.1. It is thereby possible, as mentioned above, that the individual layers 7.1, 7.2 can for example also be joined together or assembled by screws, by soldering, or by gluing, or in case of a corresponding form structure, also by shrinking.

Another embodiment of a hammer 7 according to FIGS. 10*a*–10*c* comprises a part, which is treated (thermal treatment, tempering) such that there are generated hard zones 7.5 relative to the non-treated structure and a soft zone 7.6. In this context, the hammer 7 shown in FIG. 10*a* has a cross-section shown in FIG. 10*b* in a new/used state, and the hammer 7 shown in FIG. 10*a* has a cross-section shown in FIG. 10*c* in a used state with the thereby generated self-sharpening profile.

FIG. 11 illustrates a hammer 7 in composite construction, in particular sandwich construction, wherein the harder cover layers 7.2. protrude beyond the softer core layer 7.1 in the region of the principal, active wear. This form structure is to affect, already prior to the actual wear, the desired form of wear (FIGS. 10*b* and 12*b*) as a "self-sharpening" hammer 7.

It is a goal of all these measures at the hammers 7 according to FIGS. 8 through 11 to construct the hammers as active wear parts 7 plies, layers, or zones of different quality, hardness, toughness, thickness and/or form such that they do not assume in the wear state, as was the case up to now, a wear shape according to FIG. 12*a* (longitudinal section of the hammer 7), which has the effect of being "dull" or "blunt" in the comminuting process, but that they retain their "self-sharpening" state up to the exchange, as illustrated in FIGS. 10*b* and 12*b*. It was surprisingly found that this self-sharpening state affects advantageously and substantially the increase of the service life of the active wear parts 7 as well as the comminution effectiveness and leads to a correspondingly adapted wear behavior within the total wear part system. This is further illustrated in the following in view of the cooperation with the inactive wear parts 8.

The inactive wear part 8, a so-called protective cap, comprises in the embodiment according to FIG. 13 a composite of a cover part, designated as cover face 8.1. in the present context, with a mounting support, wherein the mounting support can be composed of a bearing hub 8.2 for the attachment on the axle rods 6 (FIGS. 1, 2, 3, and 7) and a web 8.3. Advantageous assemblies of the composite result from the illustrations according to FIGS. 13*a* and *b*. For assuring a wear behavior corresponding to the active wear parts 7, the cover face 8.1 is preferably constructed multi-layered or, respectively, of the sandwich type, or is furnished with different zones such that the cover face 8.1 for example exhibits a relatively hard outer face 8.4 relative to the compound parts, plies, layers, or zones, not directly subjected to the wear.

A further composite of cover face 8.1 and the mounting support 8.2, 8.3 according to the invention is represented by the embodiment according to FIG. 14 with angled-off cover faces 8.1, which can also be comprised of angled-off, multi-layer faces or angled-off composite part faces.

For achieving an arrangement which is particularly advantageous for the correspondingly adapted wear behavior between the active wear parts 7 and the inactive wear parts 8, which is illustrated for example in FIG. 6 (schematic layout) and FIG. 7 (simplified), the cover face 8.1. is structured according to FIGS. 15 and 17 per se staggered or, respectively, notched, such that the cover face 8.1 exhibits in the course of its circumference different widths, as illustrated in the planar views in FIGS. 15 and 17. A connected grid for a correspondingly adapted wear part system is thereby formed in the mounted state, similar to the meander shape.

Based on the equipment with several mounting supports 8.2, 8.3 for each inactive wear part 8 according to FIGS. 15, 16, and 17, the service life of the arrangements for the wear part system according to the invention, which can be gathered for example from FIGS. 4, 5, and 6, can still be further increased. In these illustrations, the same capital letters designate in each case the same shapes of the cover faces 8.1 as well as the number of mounting supports 8.2, 8.3 for each inactive wear part 8.

Configurations of active and inactive wear parts 7, 8 can be realized with the cover faces 8.1, which are per se staggered or, respectively, which are notched, as well as mounting supports 8.2, 8.3 between at least three neighboring disks, according to the scheme of FIGS. 4, 5, and 6, wherein the configurations combine on the one hand the advantages of the hammers 7 (FIGS. 8 through 12) with the advantages of the protective caps 8 (FIGS. 13 through 17) in an effective way with respect to both the comminuting process as well as to a favorable wear behavior, as well as, on the other hand, increases the effectiveness of the comminution machine with respect to the power capacity. According to the invention, finally also wear parts are furnished, which are flexible in their production and which can be variably adaptable to the requirements of the wear material, and which allow the exchange of active and inactive wear parts 7, 8 at a mutually correspondingly adapted time interval. In addition, quietly running rotor arrangements can be realized, which can be adapted by way of a correspondingly adaptable wear part system to the respective material to be processed, in particular for those cases, where, for example, inclusions of foreign materials are present, where densifications for the subsequent process are to be avoided or, alternatively, are to be achieved, and where a favorable power consumption is to be assured.

COMMERCIAL APPLICABILITY

The exchange interval adaptation obtained with the invention assures an economic use in the respective technical fields of subject matter.

We claim:

1. A comminution machine comprising a rotor (2) comprising:

a plurality of disks (4);

a plurality of active wear parts (7);

a plurality of inactive wear parts (8) forming a roller-shaped jacket for protecting the rotor (2), each of the plurality of interactive wear parts (8) is detachably connected to one of the plurality of disks (4), the roller-shaped jacket having a plurality of recesses (9) through which the plurality of active wear parts (7) can move, the plurality of recesses (9) are formed between each of the plurality of inactive wear parts (8) and are staggered relative to each other, and wherein (a) each of the plurality of the inactive wear parts (8) are made, at least partially, of abrasion resistant material;

(b) each of the plurality of inactive wear parts (8) is formed by a cover face (8.1) and a support (8.2, 8.3); and (c) the roller-shaped jacket is subdivided radially and axially by the cover faces (8.1) so that the cover faces (8.1) are staggered with respect to each other, partially overlap, have different widths, and are notched such as to mesh and to form a jacket surface that provides even and balanced wear properties.

2. The combination machine according to claim 1, wherein the plurality of inactive wear parts (8) are joined detachably.

3. The comminution machine according to claim 2, wherein at least portions of the plurality of active and inactive wear parts (7,8) are constructed in form of a sandwich structure.

4. The combination machine according to claim 2, wherein the plurality of active wear parts (7) are constructed in form of a self-sharpening sandwich structure.

5. The combination machine according to claim 3, wherein at least a portion of the plurality of active and inactive wear parts (7,8) are operatively joined, and wherein at least one of the plurality of active wear parts (7) is supported on at least two of the plurality of inactive wear parts (8), and wherein each of the plurality of active wear parts (7) envelops a corresponding wear zone on a disk (4), with the wear zone defined by an outer swing circle of the respective active wear part (7).

6. The combination machine according to claim 5, wherein the active wear part (7) is made of a plurality of material layers (7.1,7.2), wherein at least one of the material layers (7.2) is harder than the remaining material layer (7.1).

7. The combination machine according to claim 6, further comprising two cover layers (7.2) with a core layer (7.1) interposed between the two cover layers (7.2), wherein the cover layers (7.2) have a greater hardness than the core layer (7.1) which is hard in the region of the bearing eye (7.3).

8. The combination machine according to claim 7, wherein the cover layers (7.2) include openings extending to the core layer (7.1).

9. The combination machine according to claim 8, wherein the active wear part (7) is bell shaped.

10. The combination machine according to claim 1, wherein each of the plurality of inactive wear parts comprised a polygonal cover face (8.1).

11. The combination machine according to claim 10, wherein the cover face (8.1) varies in width.

12. The combination machine according to claim 11, wherein the cover face (8.1) is notched such that correspondingly notched cover face of an adjacent inactive wear part can be secured to a rotor to form a closed jacket.

13. The combination machine according to claim 12, wherein each of the plurality of inactive wear parts includes a plurality of mounting supports (8.2,8.3).

14. The combination machine according to claim 13, wherein the plurality of mounting supports are axially aligned.

15. The combination machine according to claim 13, wherein the plurality of mounting supports (8.2,8.3) are circumferentially staggered.

16. The combination machine according to claim 13, comprising a combination of axially aligned and circumferentially staggered mounting supports.

17. The combination machine according to claim 16, further comprising a plurality of adjacent rotor discs and wherein the mounting supports (8.2,8.3) protrude between at least three of the plurality of adjacent rotor disks.

18. The combination machine according to claim 17, further comprising a first journal disposed on each of the mounting supports, and wherein the first journal in conjunction with a second journal disposed on an adjacent inactive wear part (8) forms a bearing for an active wear part (7).

19. The combination machine according to claim 18, wherein each of the mounting supports (8.2,8.3) covers on the disks (4) a corresponding wear zone which is essentially defined by the outer swing circle of the active wear part (7).

20. The combination machine according to claim 19, wherein the mounting supports (8.3) comprise outer contours which further comprise open recesses for attachment of the mounting supports (8.3) to axle rods (6).

21. The combination machine according to claim 1, wherein the plurality of active wear parts (7) are joined detachably.

22. The combination machine according to claim 1, wherein the plurality of active wear parts (7) are joined nondetachably.

23. The combination machine according to claim 1, wherein the plurality of inactive wear parts (7) are joined nondetachably.

* * * * *